US008759757B2

(12) United States Patent
Hardman et al.

(10) Patent No.: US 8,759,757 B2
(45) Date of Patent: Jun. 24, 2014

(54) INTERCHANGEABLE ION SOURCE FOR ELECTROSPRAY AND ATMOSPHERIC PRESSURE CHEMICAL IONIZATION

(75) Inventors: Mark Hardman, Santa Clara, CA (US); Jean-Jacques Dunyach, San Jose, CA (US); R. Paul Atherton, San Jose, CA (US); Michael W. Belford, Los Altos, CA (US)

(73) Assignee: Thermo Finnigan LLC, San Jose, CA (US)

( * ) Notice: Subject to any disclaimer, the term of this patent is extended or adjusted under 35 U.S.C. 154(b) by 9 days.

(21) Appl. No.: 13/280,069

(22) Filed: Oct. 24, 2011

(65) Prior Publication Data

US 2012/0104248 A1 May 3, 2012

Related U.S. Application Data

(60) Provisional application No. 61/408,034, filed on Oct. 29, 2010.

(51) Int. Cl.

| | |
|---|---|
| ***H01J 49/04*** | (2006.01) |
| ***H01J 49/10*** | (2006.01) |
| *H01J 49/16* | (2006.01) |
| *H01J 49/14* | (2006.01) |

(52) U.S. Cl.

CPC ..... *H01J 49/107* (2013.01); *H01J 49/165* (2013.01); *H01J 49/145* (2013.01)

USPC ..... 250/288

(58) Field of Classification Search

CPC ..... H01J 49/107

USPC ..... 250/288

See application file for complete search history.

(56) References Cited

U.S. PATENT DOCUMENTS

| | | | | |
|---|---|---|---|---|
| 4,105,916 | A * | 8/1978 | Siegel | 250/282 |
| 5,668,370 | A | 9/1997 | Yano et al. | |
| 5,753,910 | A * | 5/1998 | Gourley et al. | 250/288 |
| 5,756,994 | A | 5/1998 | Bajic | |
| 5,825,026 | A * | 10/1998 | Baykut | 250/288 |
| 6,207,954 | B1 | 3/2001 | Andrien, Jr. et al. | |
| 6,278,110 | B1 * | 8/2001 | Apffel et al. | 250/288 |
| 6,498,343 | B2 | 12/2002 | Apffel et al. | |
| 6,515,279 | B1 * | 2/2003 | Baykut | 250/285 |
| 6,541,768 | B2 | 4/2003 | Andrien, Jr. et al. | |
| 6,639,216 | B2 | 10/2003 | Apffel, Jr. et al. | |
| 6,646,255 | B2 | 11/2003 | Fukuda | |
| 6,797,946 | B2 | 9/2004 | Apffel, Jr. et al. | |
| 6,809,312 | B1 * | 10/2004 | Park et al. | 250/288 |
| 7,078,681 | B2 | 7/2006 | Fischer et al. | |
| 7,411,186 | B2 | 8/2008 | Mordehai | |
| 7,417,226 | B2 | 8/2008 | Bajic et al. | |

(Continued)

*Primary Examiner* — Nicole Ippolito
*Assistant Examiner* — Brooke Purinton
(74) *Attorney, Agent, or Firm* — Thomas F. Cooney

(57) ABSTRACT

A ion source for a mass spectrometer comprises: a capillary having a nozzle for emitting a nebulized fluid sample; an electrode of the capillary; a high voltage power supply; a second electrode disposed within or configurable to be disposed within a path of the nebulized fluid sample; and at least one switch for selecting application of an electrical potential provided by the high voltage power supply to either or both of the capillary electrode or the second electrode, wherein the capillary and capillary electrode are configurable so as to ionize the nebulized fluid sample by electrospray ionization and the second electrode is configurable so as to ionize the nebulized sample by atmospheric pressure chemical ionization.

7 Claims, 7 Drawing Sheets

(56) References Cited

U.S. PATENT DOCUMENTS

| | | | | |
|---|---|---|---|---|
| 7,488,953 | B2 | 2/2009 | Fischer et al. | |
| 2003/0071209 | A1* | 4/2003 | Park et al. | 250/288 |
| 2003/0183757 | A1* | 10/2003 | Kato | 250/281 |
| 2003/0224529 | A1* | 12/2003 | Maiefski et al. | 250/288 |
| 2006/0219891 | A1 | 10/2006 | Balogh | |
| 2006/0237663 | A1 | 10/2006 | Balogh | |
| 2006/0289782 | A1* | 12/2006 | Fischer | 250/423 F |
| 2007/0164209 | A1 | 7/2007 | Balogh | |
| 2007/0164231 | A1* | 7/2007 | Truche et al. | 250/423 R |
| 2009/0008569 | A1 | 1/2009 | Balogh | |
| 2009/0127453 | A1* | 5/2009 | Ding et al. | 250/282 |
| 2011/0031392 | A1* | 2/2011 | McEwen et al. | 250/283 |
| 2011/0174969 | A1* | 7/2011 | Seyfarth | 250/288 |

* cited by examiner

INTERCHANGEABLE ION SOURCE FOR ELECTROSPRAY AND ATMOSPHERIC PRESSURE CHEMICAL IONIZATION

CROSS-REFERENCE TO RELATED APPLICATIONS

This application claims priority under 35 USC §119(e) to U.S. Provisional Patent Application 61/408,034 filed Oct. 29, 2010, entitled "Combined Ion Source for Electrospray and Atmospheric Pressure Chemical Ionization", the entirety of which is herein incorporated by reference.

FIELD OF THE INVENTION

The present invention generally relates to mass spectrometry and, more particularly, to ion sources for generating ions from a sample and delivering the ions to a mass spectrometer.

BACKGROUND OF THE INVENTION

Mass spectrometry is a well-established method of analyzing for the presence and concentration (or amount) of a wide variety of chemical constituents with high sensitivity. Since mass spectrometric analysis includes detection or quantification of various ions having varying mass-to-charge ratios, it is necessary to ionize the molecules of chemical constituents of samples of interest. Heated electrospray ionization (HESI) and atmospheric pressure chemical ionization (APCI) are two common ionization techniques that may be employed to ionize chemical constituents of samples provided in liquid form. These two techniques are somewhat similar in the sense that both require nebulization of a liquid sample spray within a flow of heated gas. However, some fundamental differences exist between the two techniques. The HESI source sprays a nebulized liquid spray where the tip of the sprayer (e.g., a nozzle such as of a capillary tube) has or provides an electrical potential that transfers charge to the droplets. These droplets are then dried by a heated flow of gas before being injected into the mass spectrometer. Although the APCI source also emits a spray of nebulized liquid, the tip of the sprayer does not carry an electrical charge and, in fact, is often grounded. The neutral droplets so produced are dried by a heated flow of gas and then are ionized by way of a corona discharge needle placed between the sprayer and the mass spectrometer.

A HESI sprayer is long enough so that the tip sits outside of the heater region so that the drying gas is heated but the liquid flow is not directly heated. Conversely, an APCI sprayer is shorter so that it sits within the heater region so that the liquid droplet flow is directly heated.

The two above-described ionization techniques are, to some extent, complementary because certain classes of compounds that ionize well in HESI (or ESI) mode often do not ionize well in APCI mode, and vice versa. In some high throughput screening applications, where the amount of sample available is limited and where time is critical, it is desirable to limit the amount of time required in order to identify all the components in the sample. Therefore, it is desirable to be able to switch between the two aforementioned ionization modes with a minimum of time and inconvenience.

SUMMARY

To address the need for easy and convenient changeover or switching between ESI (or HESI) and APCI ion sources, two related approaches are disclosed herein. Accordingly, in a first aspect of the present teachings, a switchable ion source is provided that can operate in either an HESI-only mode, an APCI-only mode or a "combined mode". The apparatus facilitates easy and rapid selection between HESI (or ESI) and APCI ionization techniques and, in the combined mode, enables two types of ionization mechanisms to be performed simultaneously to ionize a single sample. Accordingly, a combination HESI/APCI source is described so that either HESI or APCI can be achieved using the same source housing. This is achieved by producing a sprayer having a length intermediate between the lengths of conventional HESI-only and APCI-only sprayers. Furthermore, when HESI mode is in use, the sprayer tip receives an electrical potential and the corona discharge needle is grounded. When APCI mode is in use, the sprayer tip is grounded (or given a small electrical potential) and the corona discharge needle is supplied an electrical potential. Software may be employed to switch between HESI and APCI operational modes between analyses employing different analysis protocols. A single power supply is provided so as to provide operating voltage to either an HESI sprayer, to an APCI needle electrode or to both the sprayer and the APCI needle. The APCI needle may be provided on a moveable or rotatable support that may permit the APCI needle to physically move, under software control, between two positions: a first position—used when Atmospheric Pressure Chemical Ionization is in effect—between the nozzle and an ion inlet aperture of a mass spectrometer and a second position—used when APCI is not in effect—that is removed from the region between the nozzle or sprayer and the ion inlet aperture.

In a second aspect of the present teachings, modular interchangeable HESI (or ESI) and APCI nozzle assemblies are disclosed, either of which may be mated to a common housing which provides all necessary gas and electrical connections to the mated nozzle assembly. The HESI nozzle assembly includes a single electrical contact that, in operation, mates with an electrically live electrical contact of the housing. Since the single electrical contact of the HESI probe is in electrical communication with the HESI nozzle or sprayer, an operating voltage may thus be applied to the HESI nozzle or sprayer. The APCI nozzle assembly includes a first electrical contact that, in operation, mates with the same electrically live electrical contact of the housing. The APCI nozzle assembly further includes a second electrical contact that, in operation, mates with a second electrical contact of the housing. The first and second electrical contacts of the APCI nozzle assembly are in electrical communication with one another. However, these two electrical contacts may not be in electrical communication with the nozzle or sprayer portion. Thus, in operation, the APCI nozzle assembly may provide a simple electrical bridge between the two electrical contacts of the housing. Since the second housing electrical contact is in electrical communication with an APCI needle within the housing, operating voltage may thus be provided to the APCI needle when the APCI housing assembly is in its operating position.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To appreciate the features of the present invention in greater detail, please refer to FIGS. 1-7 in conjunction with the following discussion.

The terms "mass spectrometry" or "MS" as used herein refer to methods of filtering, detecting, and measuring ions based on their mass-to-charge ratio, m/z, sometimes given in units "Da/e" (Daltons per elemental charge unit). In general, one or more molecules of interest are ionized and the ions are subsequently introduced into a mass spectrometer instrument where, due to a combination of magnetic or electric fields, the ions follow a path in space that is dependent upon mass ("m" or "Da") and charge ("z" or "e").

After the sample has been ionized, the positively charged or negatively charged ions thereby created may be analyzed to determine a mass-to-charge ratio (i.e., Da/e). Suitable analyzers for determining mass-to-charge ratios include quadrupole analyzers, ion trap analyzers, time-of-flight analyzers, electrostatic trap analyzers as well as others. The ions may be detected by using several detection modes. For example, selected ions may be detected (i.e., using a selective ion monitoring mode (SIM)), or alternatively, ions may be detected using selected reaction monitoring (SRM) or multiple reaction monitoring (MRM). Ions can also be detected by scanning a mass spectrometer to detect all the precursor ions simultaneously or all the products ions of a specific precursor ion simultaneously or both.

Figure 1:
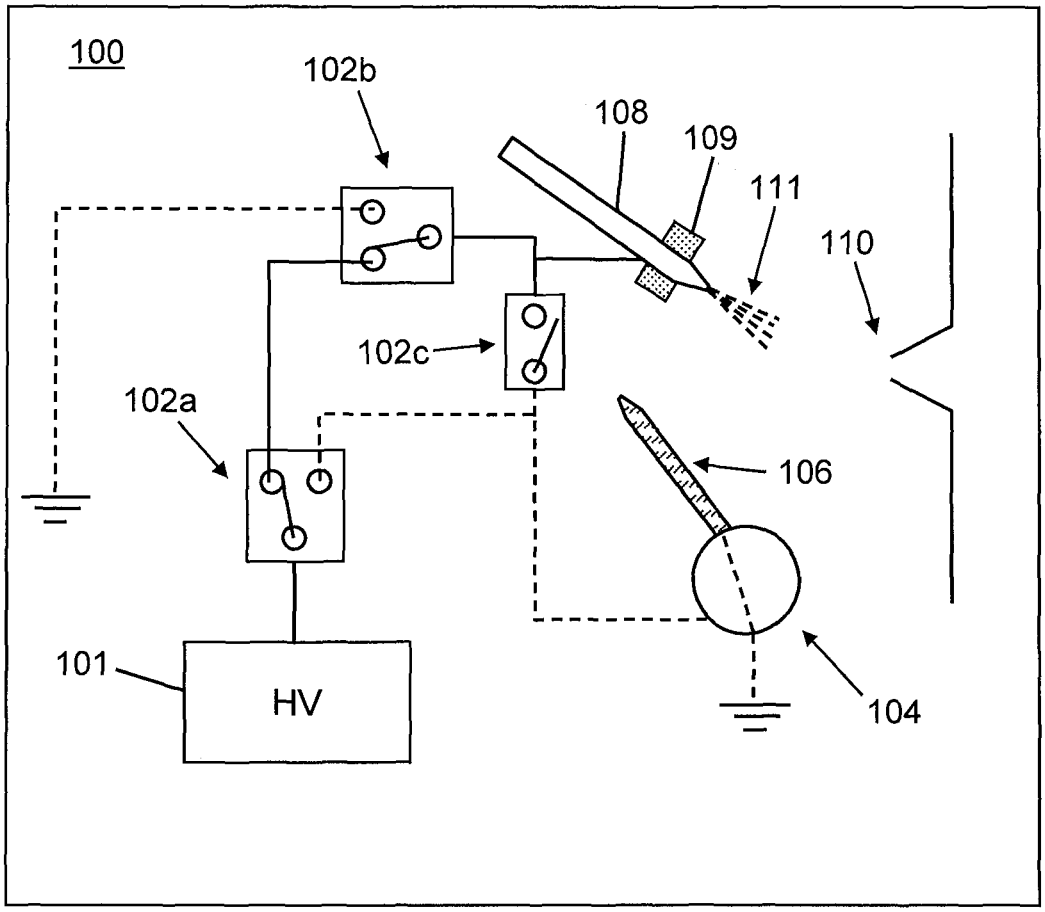
FIG. 1 is a schematic illustration of a combination ion source in accordance with the present teachings operated in a configuration so as to generate ions only by electrospray (ESI) or heated electrospray (HESI) ionization.
Figure 2:
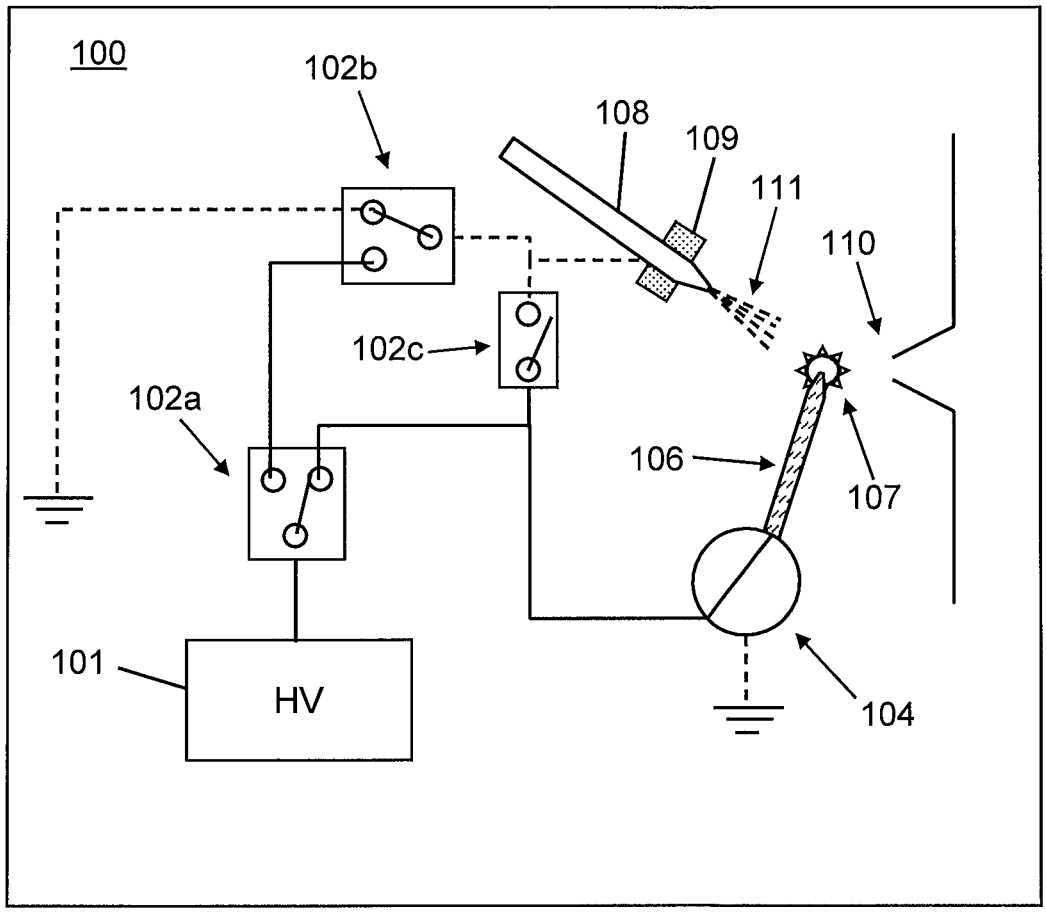
FIG. 2 is a schematic illustration of the combination ion source of FIG. 1 operated in a first alternative configuration so as to generate ions only by Atmospheric Pressure Chemical Ionization (APCI)
Figure 3:
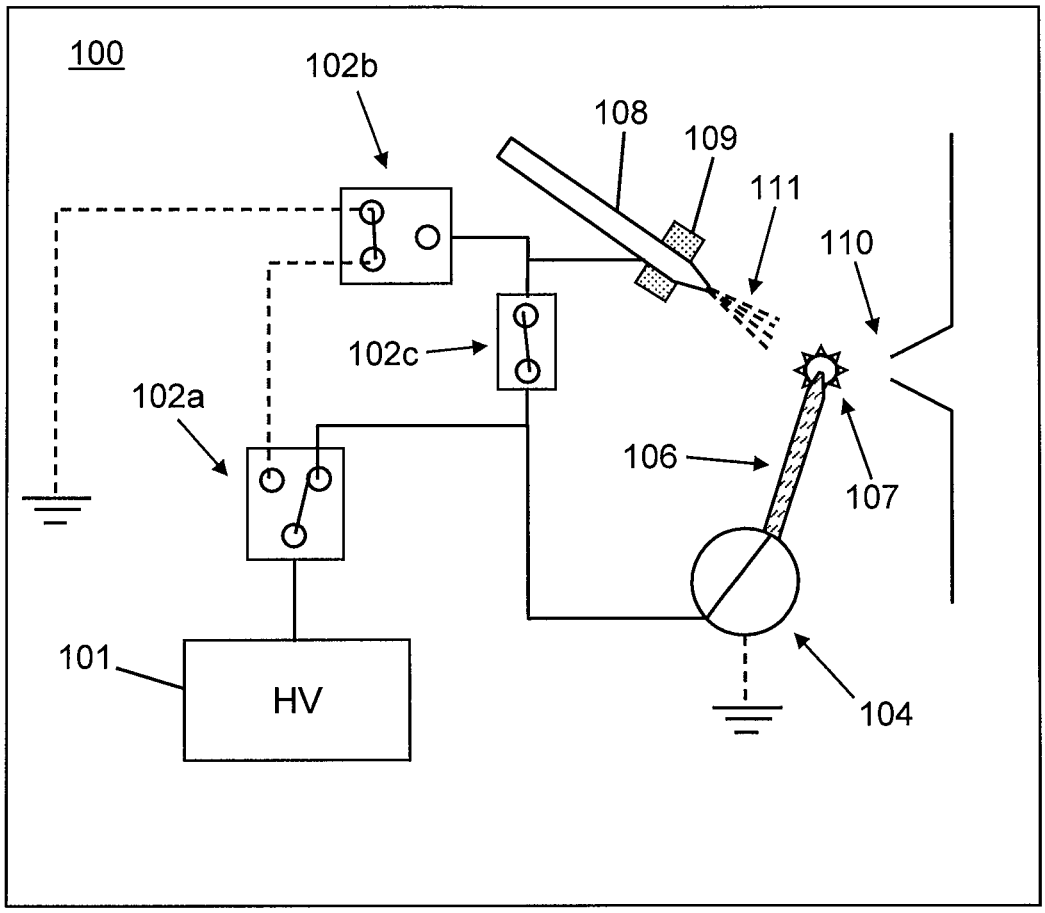
FIG. 3 is a schematic illustration of the combination ion source of FIG. 1 operated in a second alternative configuration so as to generate ions simultaneously by ESI (or HESI) and by APCI.

FIGS. 1-3 illustrate various embodiments of an ionization apparatus 100 in accordance with the present teachings utilized in three different modes of operation. The apparatus 100 comprises a capillary 108 that receives a sample stream from, for instance, a liquid chromatograph column and that nebulizes the sample, possibly with pneumatic assistance from a sheath gas delivered by means of a gas channel (not shown) surrounding or adjacent to the capillary. The capillary 108 or the flowing sample in the capillary may be maintained at a high voltage provided by a high-voltage power supply 101 that is electrically coupled to the capillary or to the sample by a series of electrical lines including switches 102*a*-102*c*. The capillary may thus be used as an electrospray ion source under the influence of an electric field developed as a result of a voltage difference between the capillary or the sample and a counter electrode. Accordingly, the capillary 108 may also be referred to as an HESI needle (or, simply, as a "nozzle") in this document. In operation, a spray 111 of droplets and possibly free ions is emitted from an end of the capillary 108 in the direction of an ion inlet aperture 110 of a vacuum chamber of a mass spectrometer. Nebulization of the sample and evaporation of solvent may be assisted by a heater 109 in thermal contact with the capillary.

The novel apparatus 100 further comprises an APCI corona discharge electrode (e.g., a needle) 106 that may be fitted to a moveable support structure 104, such as a rotating stage (as illustrated). The moveable support structure 104 is operable so as to either position a tip of the needle 106 outside of the spray 111 (in a first position as shown in FIG. 1), or alternatively, to position the needle tip within the spray 111 (in a second position as shown in FIG. 2). The movement of the APCI needle 106 (or equivalently, of the moveable support 104) between these first and second positions may cause an electrical contact that is coupled to the APCI needle to either come into contact with ground potential so as to maintain the needle 106 at ground potential or to come into contact with an electrical line that may be placed in electrical continuity with the high-voltage supply 101. Concurrently with the movement of the APCI needle 106 between these first and second positions, the electrical switches 102*a*-102*c* are reconfigured so as to provide voltage from the high voltage source 101 to either the HESI needle 108 or to the APCI needle 106 (or both), thereby allowing easy changeover between HESI, APCI and combined ionization modes.

In either the HESI (FIG. 1) or APCI (FIG. 2) mode of operation, an analyte-bearing liquid, comprising the analyte dissolved in a suitable solvent, is caused to flow through the capillary 108. The liquid is caused to be nebulized and ejected from the capillary, at least in part, by an inert sheath gas (not shown) which flows around an outlet aperture of the capillary. The formation or liberation of ions from the resulting droplets varies, as described below, depending on which ionization mode is employed. The ions are then input to a vacuum chamber of a mass spectrometer (not shown) for mass analysis through an ion inlet aperture 110.

In the HESI mode of operation, shown below in FIG. 1, charged liquid droplets are emitted from the capillary outlet aperture under exposure of the liquid in the capillary to a high voltage, taken with reference to the voltage of a counter electrode. The electrode may comprise a wire passing through the bore of the capillary or may comprise a conductive coating on the capillary tip. Alternatively, the capillary may be fabricated from a conductive material so as to, itself, be the electrode. The ion inlet aperture of a mass spectrometer may function as the counter electrode, or a separate electrode between the capillary and the MS ion inlet aperture may fulfill this function. The high voltage difference may be achieved by applying high voltage, supplied from HV power supply 101, to the capillary electrode and maintaining the counter electrode at ground potential. With a proper application of voltage and flow, a Taylor cone is formed at the capillary outlet aperture which breaks up into a plume (spray) of emitted charged droplets. De-solvation and solvent evaporation causes analyte ions to be liberated from these droplets.

As mentioned above, the novel ion source apparatus also includes a corona discharge electrode (e.g., an APCI needle) 106 which may be moved into or out of the path between an outlet aperture of the capillary 108 (a capillary tip) and the MS ion inlet aperture 110. As shown in the present diagrams, the corona discharge electrode may be supported by a rotatable stage which can rotate through an angle. In the HESI-only (or ESI-only) mode of operation (FIG. 1), the rotatable stage is positioned such that the corona discharge electrode is rotated to a position where its presence has no effect, electrostatic or otherwise, on performance. In this position, it is also not subject to contamination by the spray. However, in an APCI-only mode of operation, shown in FIG. 2, the needle is rotated to a position normal for APCI mode—that is, between the tip of the capillary 108 and the MS ion inlet aperture 110. Although the corona discharge electrode is shown, in the accompanying figures, as being attached to a rotating stage, it is to be kept in mind that the positioning and re-positioning of this electrode may be facilitated with the aid of any other type of moveable support, such as a translation stage. The position of the moveable support and electrode may be changed with a manual control accessible from the outside of the ion source housing or, alternatively, with a stepper motor. When employed, such a stepper motor may be controlled by a computer or other electronic controller module (not shown) for automatic switching.

As may be observed by inspection of FIG. 2, during operation in APCI-only mode, the capillary electrode is grounded (or maintained at a relatively low electrical potential) and the high voltage from the supply HV is routed to the corona discharge needle so as to cause development of a corona discharge 107 within the path of the spray 111. The corona discharge generally represents ionized solvent vapor. This ionized solvent vapor then acts as a chemical ionization reagent so as to form the desired analyte ions by reaction. This configuration is in contrast to the configuration used for operation in HESI-only (or ESI-only) mode (see FIG. 1), in which high voltage is supplied to the capillary electrode and the corona discharge electrode is not energized or is grounded. When operation is in the HESI-only mode, the corona discharge electrode could alternatively be connected to another intermediate voltage (not shown) so as to further minimize any electrostatic effect on fields within the source housing and speed up switching. The voltage routing may be accomplished with the aid of one or more switches, as shown in schematic fashion in the accompanying figures. The switches may be mechanical or electronic and may be operated manually or automatically under the control of a computer or other electronic controller module (not shown).

As illustrated in FIG. 3, the apparatus 100 allows for a combined mode of operation, in which the APCI needle is in the APCI position, and both the electrode associated with the HESI capillary and the corona discharge electrode (APCI needle) are energized. This mode resembles HESI, with high voltage applied the capillary tip, but also includes APCI, with high voltage routed to the corona discharge electrode. In this combined mode of operation, the APCI needle and HESI sprayer operate in tandem, thus possibly producing a wider variety of ions than would be generated by using either one of the HESI or APCI techniques alone.

Figure 4:
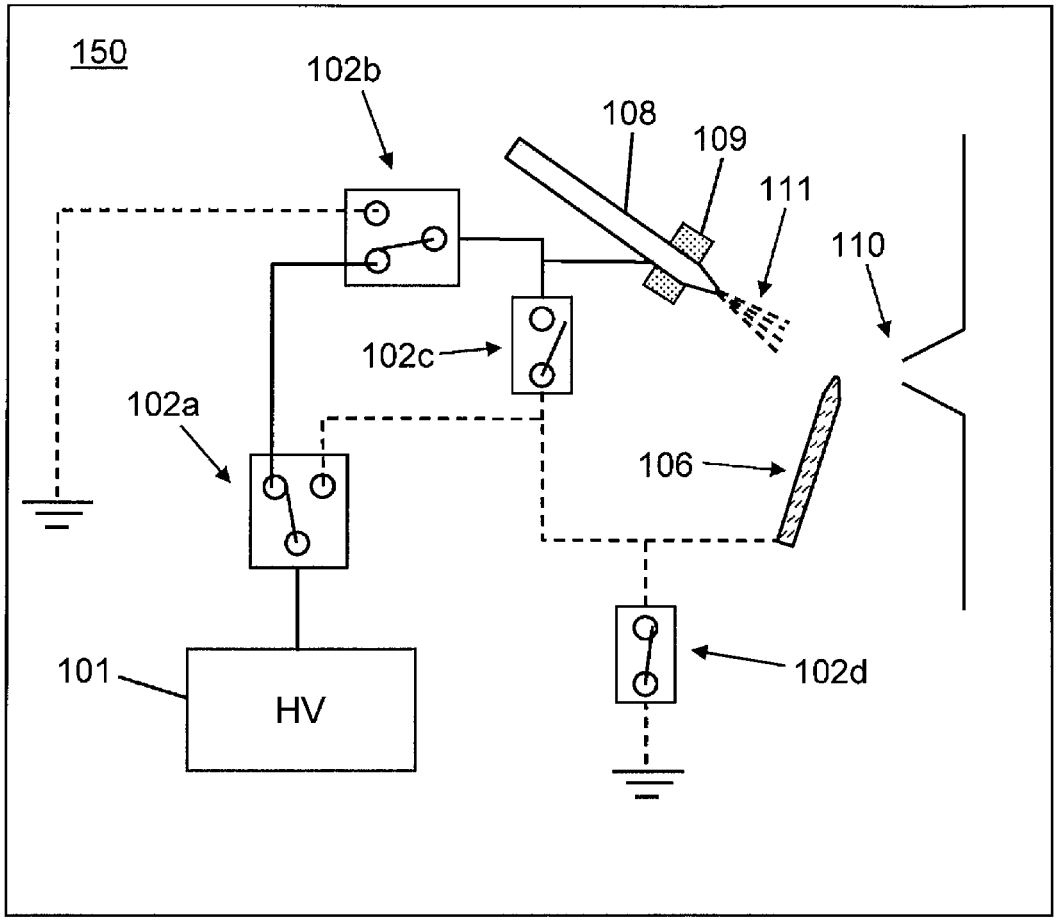
FIG. 4 is a schematic illustration of another combination ion source in accordance with the present teachings operated so as to generate ions only by ESI or HESI ionization.

FIG. 4 is a schematic illustration of an alternative ion source 150 in accordance with the present teachings. The ion source 150 is similar to the source 100 (FIGS. 1-3) except that the APCI needle 106 is not moveable and remains fixed in position even when the apparatus is operated in electrospray mode, without APCI ionization. An additional switch or switches, such as switch 102*d* may be employed operated so as to connect the APCI needle 106 to ground or to some other potential when APCI mode is not in operation. FIG. 4 only shows an operating mode or configuration in which ions are only generated by the HESI (or HESI) process and, thus, is analogous to FIG. 1. However, APCI-only and combined ionization modes are also possible.

Figure 5:
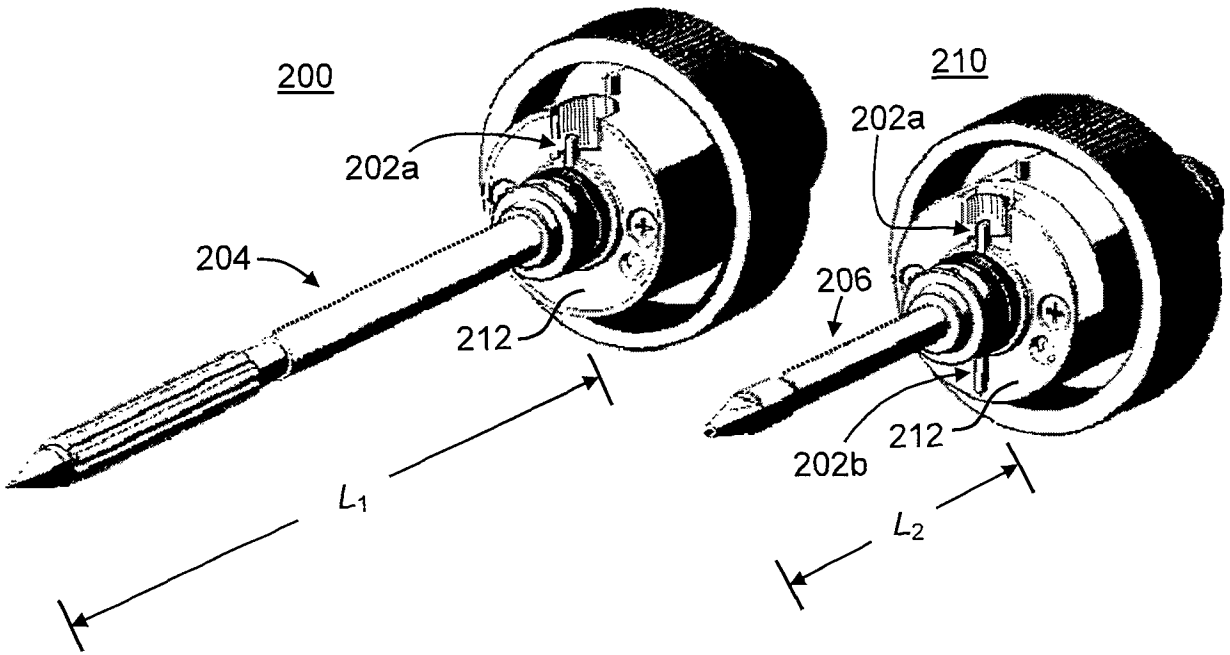
FIG. 5 is a perspective illustration of an HESI source probe and a perspective illustration of a separate APCI probe, the HESI and APCI source probes being interchangeable within a single housing in accordance with another aspect of the present teachings.

FIG. 5 illustrates perspective views of an HESI nozzle assembly 200 and an APCI nozzle assembly 210, in accordance with another aspect of the present teachings. The HESI and APCI source nozzle assemblies shown in FIG. 5 are modular and interchangeable in the sense that can both be mated to a single housing that provides all necessary electrical and gas connections to either nozzle assembly. The housing also provides the heater for the nozzle and the APCI needle. In order to reconfigure a mass spectrometer so as to use one or the other of the ionization techniques, a user manually removes one of the source nozzle assemblies and replaces it with the other assembly. All electrical and gas connections are hidden within the housing and, thus, such removal and replacement is a simple and fast procedure.

As is illustrated in FIG. 5, the nozzle 204 of the assembly 200 employed for electrospray ionization has a length $L_1$ which is greater than the length $L_2$ of the nozzle 206 of the assembly 210 employed for APCI ionization. These different lengths are in accordance with the different optimal nozzle-to-aperture distances for these two ionization modes, as determined by experiment. The nozzle-to-aperture distance is analogous to the distance between the emitting tip of capillary (or nozzle) 108 and the ion inlet aperture 110 in FIGS. 1-4.

The separate nozzle-to-aperture distances for the modular interchangeable HESI and APCI nozzle assemblies (FIG. 5) are to be distinguished from the single nozzle-to-aperture distance for the embodiments illustrated in FIGS. 1-4. In both the combination ion source 100 (FIGS. 1-3) and the combination ion source 150 (FIG. 4), the single nozzle-to-aperture distance is configured intermediate between the respective optimal nozzle-to-aperture distances corresponding to HESI and APCI operation. In this fashion, the ionization performance of the combination ion sources 100, 150 is adequate for each of the modes of operation without requiring mechanical adjustment of the nozzle.

The HESI nozzle assembly 200 (FIG. 5) comprises a single electrical contact 202*a* which mates with an electrical contact of the housing (described following). The APCI nozzle assembly 210 (FIG. 5) also incorporates the electrical contact 202*a* as well as a second electrical contact 202*b* that mates with a second electrical contact of the housing. The electrical contact 202*a* of the HESI nozzle assembly 200 is in electrical communication with an electrode of the nozzle 204 and, thus, in operation, may provide a high voltage to the electrode of the nozzle 204. In contrast, the electrical contact 202*a* of the APCI nozzle assembly 210 is in electrical communication with the second electrical contact 202*b* but may not be in electrical communication with an electrode of the nozzle 206.

Figure 6:
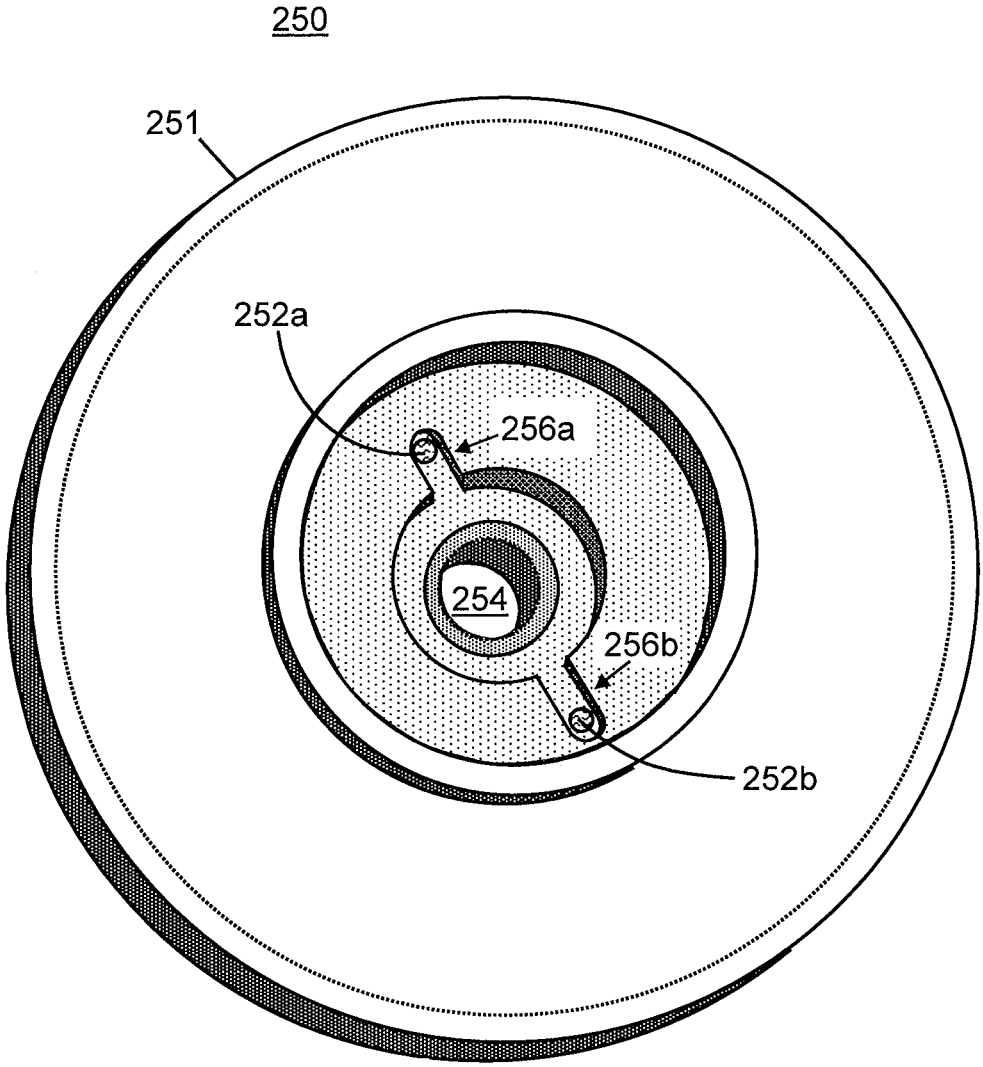
FIG. 6 is a perspective view of a receptacle of a housing for the HESI and APCI source probes of FIG. 5.

FIG. 6 is a perspective view of a receptacle portion of a housing for the HESI and APCI source probes of FIG. 5. The housing 250 comprises a flat plate portion 251 which, in operation, comes into sealing contact (perhaps by means of an intermediate gasket or O-ring) against a mating flat plate portion 212 of either of the HESI and APCI nozzle assemblies 200, 210 shown in FIG. 5. A channel 254 within the housing admits and provides a passageway for either of the nozzles 204, 206 when the respective nozzle assembly is in operational position. At least one recessed area surrounding the channel 254 comprises slots or grooves 256*a* and 256*b*. A respective electrical contact of the housing is disposed within each such slot or groove. Thus, first electrical contact 252*a* is disposed within the recessed area within slot or groove 256*a* and second electrical contact 252*b* is disposed within the recessed area within slot or groove 256*b*. The first electrical contact 252*a* is in electrical communication with an electrical power supply apparatus and thus is maintained at a live high voltage. The second electrical contact 252*b* is in electrical communication with an APCI needle that is disposed within the housing. The APCI needle is energized only when voltage is supplied to the second electrical contact 252*b*.

The electrical contacts of the housing are designed to mate with respective electrical contacts of the nozzle assemblies. Thus, the electrical contact 252*a*, which has a live voltage provided from a power supply, mates with the electrical contact 202*a* of either the HESI nozzle assembly 200 or the APCI nozzle assembly 210. When the HESI nozzle assembly 200 is in operating position in contact with the housing, high voltage is supplied to an electrode of the nozzle 204 via the contact between electrical contact 202*a* and electrical contact 252*a*. Since the HESI nozzle assembly 200 does not have a mating electrical contact to mate with the second housing electrical contact 252*b*, the APCI needle is not energized when the HESI nozzle assembly is installed. However, when the APCI nozzle assembly 210 is in operating position in contact with the housing, electrical continuity is established between the two electrical contacts 252*a* and 252*b* that are within the housing, since the APCI nozzle assembly 210 provides an electrical bridge. Thus, when the APCI nozzle assembly 210 is in operating position, high voltage is supplied to the APCI needle within the housing. In some embodiments, the electrical contact 202*a* of the APCI nozzle assembly 210 may not be in electrical contact with an electrode of the nozzle 206 or, in fact, the nozzle 206 may not even have an electrode associated with it. However, in other embodiments an electrode may be provided as part of the nozzle 206 and said electrode may be in electrical communication with the electrical contact 202*a*. In such embodiments, both an electrode of the nozzle as well as an APCI needle may be energized simultaneously, so that ions are produced by both of the electrospray and atmospheric chemical ionization processes. In such embodiments, the nozzle length $L_2$ may be longer that as shown in FIG. 5 so as to provide adequate ionization by both processes simultaneously.

Novel ion sources for mass spectrometry have been disclosed. The above-described apparatus allows switching between HESI (or ESI) only, APCI only and combined mode with a minimum of inconvenience, and, in various embodiments, with no compromise of performance when in HESI only or APCI only modes. The HESI, APCI, and combined sprayers can consist of easy to change sprayer inserts. As an additional advantage, the embodiments shown in FIGS. 1-4 do not require manual intervention by a user in order to switch between ionization modes. Thus, the embodiments illustrated and discussed herein, or variants thereof, may be utilized in clinical mass analyzers (which may provide limited opportunities for manual user intervention) such as, for example, the mass analyzers described in a co-pending U.S. Provisional Application for patent, Appl. No. 61/408,180 titled "Automated System for Sample Preparation and Analysis" filed on Oct. 29, 2010 and incorporated by reference herein as if fully set forth herein.

Figure 7:
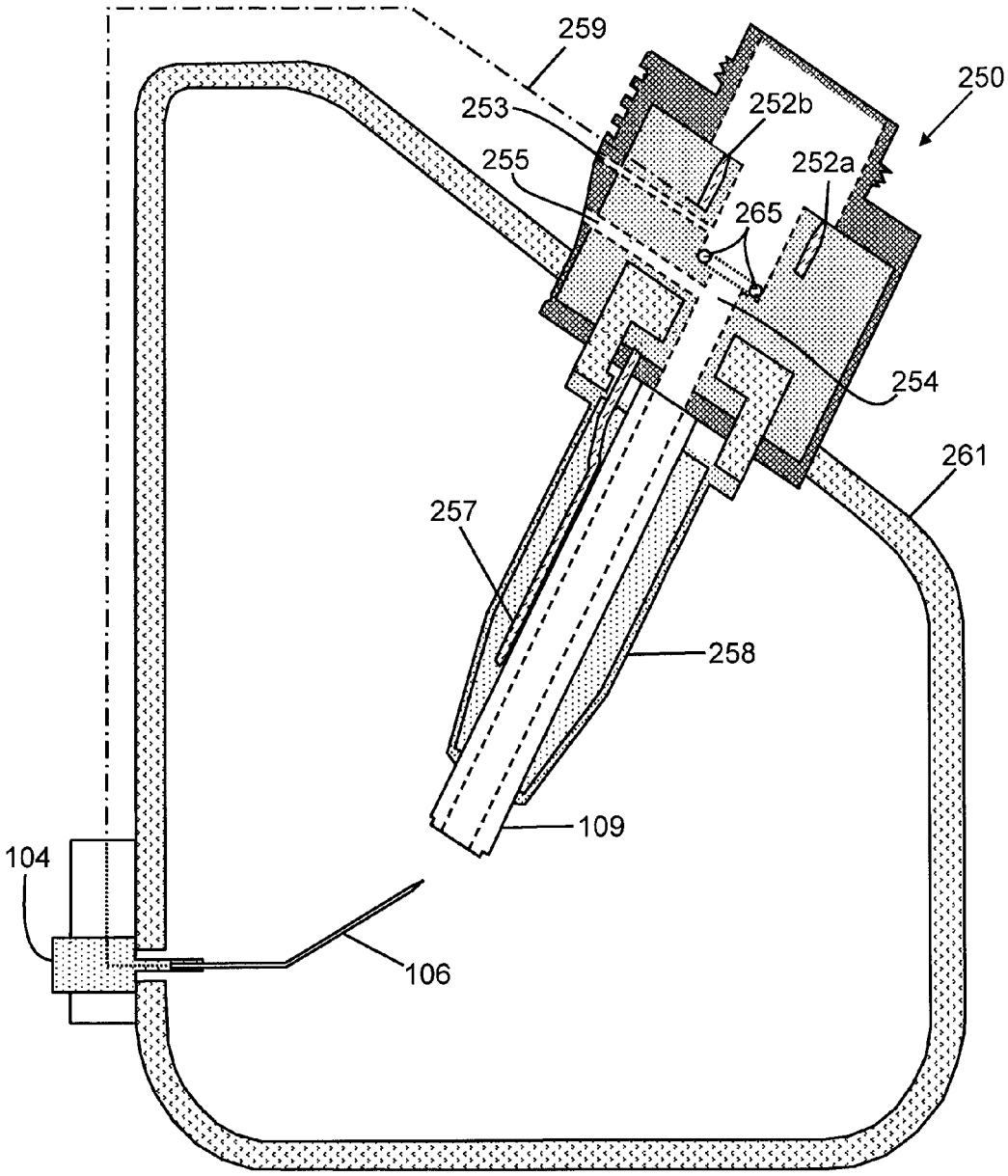
FIG. 7 is a schematic cross-sectional view of a an ionization chamber and common housing for the HESI and APCI nozzle assemblies of FIG. 5.

FIG. 7 is a schematic cross-sectional view of the common housing 250 for the HESI and APCI nozzle assemblies of FIG. 5, mounted onto an ionization chamber 261. The second electrical contact 252*b*, which makes contact with a pin of the APCI nozzle assembly 210, is electrically connected to the APCI needle electrode 106 by means of an electrical conductor 259 such as a wire. Although the electrical conductor 259 is shown disposed externally to the housing 250 and ionization chamber 261 in FIG. 7, it may be alternatively mounted in any fashion, such as disposed within the housing 250 or ionization chamber 261 or within one or more channels within or attached to these components. A first gas inlet port 253 provides a nebulizing gas which, in operation, is introduced into a mating inlet hole in either the HESI nozzle assembly 200 or the APCI nozzle assembly 210. The nebulizing gas is carried through a dedicated channel or passageway in either of the nozzle 204 or the nozzle 206 to the nozzle tip where it assists in producing a fine spray of droplets from a sample. A second gas inlet port 255 is used to introduce an auxiliary gas which assists in desolvation of the sample droplets. The auxiliary gas is prevented from escaping the housing to atmosphere by O-ring 265. The housing 250 includes a common heater 109 which, in operation, is used to heat the auxiliary gas and droplets after they exit either the HESI or APCI nozzle tip in order to facilitate desolvation. The heater 109 is supported by a heater support 258 and is mounted in contact with a thermocouple 257 that is employed, in operation, for temperature measurement and control. The movable support 104 for the APCI needle 106 may be operated by a motor or may, as illustrated in FIG. 7 be mounted to a wall of the ionization chamber 261 so as to be manually operable by a user.

The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention. All patent application disclosures, patent application publications or other publications are hereby explicitly incorporated by reference herein as if fully set forth herein.

What is claimed is:

1. A system for ionizing samples for input to a mass spectrometer, comprising:

a housing mounted on an ionization chamber of the mass spectrometer and within an opening of the ionization chamber, the housing comprising:

a channel through the housing;

a first electrical contact, said first electrical contact configurable to be in electrical communication with a high voltage power supply; and a second electrical contact, said second electrical contact in electrical communication with a corona discharge electrode disposed proximal to an ion inlet aperture of the mass spectrometer;

a first assembly matable with the housing, comprising:

a capillary having a nozzle for emitting a nebulized fluid sample, the capillary disposed within the channel of the housing when the first assembly is mated to the housing;

an electrode of the capillary; and an electrical contact in electrical communication with the electrode, the electrical contact in electrical communication with the first electrical contact of the housing when the first assembly is mated to the housing; and a second assembly matable with the housing, comprising:

a capillary having a nozzle for emitting a nebulized fluid sample, the capillary disposed within the channel of the housing when the second assembly is mated to the housing;

a first electrical contact in electrical communication with the first electrical contact of the housing when the second assembly is mated to the housing; and a second electrical contact in electrical communication with the second electrical contact of the housing when the second assembly is mated to the housing, wherein the first and second assemblies are interchangeably matable with the housing for ionizing the sample by electrospray ionization (ESI) and atmospheric pressure chemical ionization (APCI) respectively.

2. A system as recited in claim 1, further comprising:

a gas channel of the housing supplying a nebulizing gas;

at least one gas channel of the first assembly for receiving the nebulizing gas when the first assembly is mated to the housing and for delivering the nebulizing gas to a vicinity of a tip of the capillary of the first assembly; and at least one gas channel of the second assembly for receiving the nebulizing gas when the second assembly is mated to the housing and for delivering the nebulizing gas to a vicinity of a tip of the capillary of the second assembly.

3. A system as recited in claim 1, further comprising:

a heater of the housing for heating the nebulized fluid sample emitted by either the capillary of the first assembly or the capillary of the second assembly.

4. A system as recited in claim 1, wherein the first and second electrical contacts of the second assembly are in electrical communication with one another such that, when the second assembly is mated to the housing and in operation, voltage is provided to the corona discharge electrode from the high voltage power supply via the first electrical contact of the housing, the first and second electrical contacts of the second assembly and the second electrical contact of the housing.

5. A system as recited in claim 4, wherein the second assembly further comprises:

an electrode of the capillary nozzle of the second assembly that is in electrical communication with the first electrical contact of the second assembly.

6. A system as recited in claim 1, further comprising:

a moveable support mounted on the ionization chamber and on which the corona discharge electrode is provided.

7. A system as recited in claim 1, wherein the housing further comprises:

a receptacle portion with which the first and second assemblies are matable, the receptacle portion comprising:

a recessed area surrounding the channel of the housing and having a first and a second slot or groove, wherein the first electrical contact of the housing is disposed within the first slot or groove and the second electrical contact of the housing is disposed within the second slot or groove.

* * * * *